United States Patent [19]

Iwamoto

[11] Patent Number: 4,685,833

[45] Date of Patent: Aug. 11, 1987

[54] OFFSHORE STRUCTURE FOR DEEPSEA PRODUCTION

[76] Inventor: William T. Iwamoto, 15 Northampton Ave., Berkeley, Calif. 94707

[21] Appl. No.: 912,050

[22] Filed: Sep. 25, 1986

Related U.S. Application Data

[63] Continuation of Ser. No. 767,656, Aug. 20, 1985, abandoned, which is a continuation-in-part of Ser. No. 594,309, Mar. 28, 1984, abandoned.

[51] Int. Cl.[4] ..... E02D 21/00; E21B 43/01

[52] U.S. Cl. ..... 405/195; 405/202; 405/210; 405/224; 166/357; 166/367

[58] Field of Search ..... 405/195, 202–208, 405/210, 224, 227; 166/357, 359, 367, 350; 175/5–10; 114/256, 257, 264, 265

[56] References Cited

U.S. PATENT DOCUMENTS

| | | | |
|---|---|---|---|
| 3,395,755 | 8/1968 | Manning | 175/8 |
| 3,488,967 | 1/1970 | Toossi | 175/7 X |
| 3,667,240 | 6/1972 | Vilain | 405/202 |
| 3,768,268 | 10/1973 | Laffont et al. | 405/202 |
| 3,875,998 | 4/1975 | Charpentier | 175/8 X |
| 3,881,549 | 5/1975 | Thomas | 405/203 X |
| 3,921,558 | 11/1975 | Redshaw | 405/210 X |
| 4,026,119 | 5/1977 | Dotti | 405/202 |
| 4,127,003 | 11/1978 | Vilain | 405/202 |
| 4,175,890 | 11/1979 | Taylor | 405/202 |
| 4,284,143 | 8/1981 | Scherrer et al. | 166/357 X |
| 4,326,312 | 4/1982 | Tang | 405/202 X |
| 4,375,835 | 3/1983 | Archer | 166/357 X |
| 4,462,717 | 7/1984 | Falcimaigne | 405/224 X |
| 4,511,287 | 4/1985 | Horton | 405/205 X |

FOREIGN PATENT DOCUMENTS

| | | | |
|---|---|---|---|
| 2806240 | 8/1978 | Fed. Rep. of Germany | 405/210 |
| 1366770 | 9/1974 | United Kingdom | 405/210 |
| 2006860 | 5/1979 | United Kingdom | 405/202 |
| 2133446 | 7/1984 | United Kingdom . | |

*Primary Examiner*—Cornelius J. Husar
*Assistant Examiner*—Nancy J. Stodola
*Attorney, Agent, or Firm*—Flehr, Hohbach, Test, Albritton & Herbert

[57] ABSTRACT

An offshore structure for deepsea production of this invention is designed for achieving economy both in installation and in operation. It consists mainly of a base to be founded on a sea-bed, a buoyant body having a separator segregated from the sea for storing and separating the produced fluids and an elongate tensioned member for connecting the base and the buoyant body and transporting the produced fluids from the well through the base to the separator near the surface of the sea. The separator has a compartmentalized outer wall for controllably variable ballasting and deballasting.

18 Claims, 3 Drawing Figures

OFFSHORE STRUCTURE FOR DEEPSEA PRODUCTION

This is a continuation of application Ser. No. 767,656 filed Aug. 20, 1985, now abandoned, which is a continuation-in-part of application Ser. No. 594,309 filed Mar. 28, 1984, now abandoned.

This invention relates generally to a buoyant offshore structure for deepsea production and more particularly to an economically installable offshore structure suited for single well production as well as for early production and extended reservoir testing of deepwater fields.

The risk-taking element in deepsea drilling and production of oil remains even after the exploration phase. This is particularly the case where a multiwell system is installed as frequently done for one reason or another before accurately determining the full physical extent of the reservoir and its long term producing characteristics. According to a typical method using a semisubmersible platform, a subsea manifold is disposed on the sea-bed and is connected via subsea pipelines to several subsea production trees at remote wells. Capital expenditures for establishing such an offshore system are generally very large. Should it become necessary for major workover purposes, for example, to position a separate flaoting or buoyant system over one of the remote wells, the total expense becomes even higher.

Additional expenses are incurred, furthermore, when land facilities must be upgraded to handle deep draft bulk cargo vessels such as large, very large and ultralarge crude carriers. By limiting the producing system to one well, the volume of production can be carried by shallower draft vessels which can use navigable waterways maintained by agencies such as the U.S. Corps of Engineers. Very few deepwater facilities exist world wide and this severely limits early production and extended reservoir testing production because these reservoirs are generally remote from deepwater ports and cargo terminals. Often, expensive pipelines and/or special deepwater facilities are specially constructed to handle deep draft vessels. Additional expenses can also occur with deep draft vessels which by definition have large widths. Restricted width waterways, such as the Panama Canal, deny passage for such vessels. Shallower, narrower vessels can traverse restricted width waterways, thereby circumventing such problems.

It is therefore an object of this invention to provide an economically advantageous deepsea production system suited for single well production.

It is another object of the present invention to provide a deepsea production system in which major components are adaptable and intended for mass production.

It is a further object of the present invention to provided an offshore structure with process and storage facilities integrally incorporated into a tensioned single central leg anchored system.

It is still a further object of the present invention to provide an offshore structure for production occupying a minimum plan view area so that the site may be restored easily upon abandonment of the system.

The above and other objects of the present invention are achieved by providing a system of which the main components are a base assembly founded on the seabed, a central leg assembly allowing vertical alignment for direct access to well bore tubing and a buoy with facilities for storage and separation of the produced fluids.

DETAILED DESCRIPTION OF THE INVENTION

Figure 1:
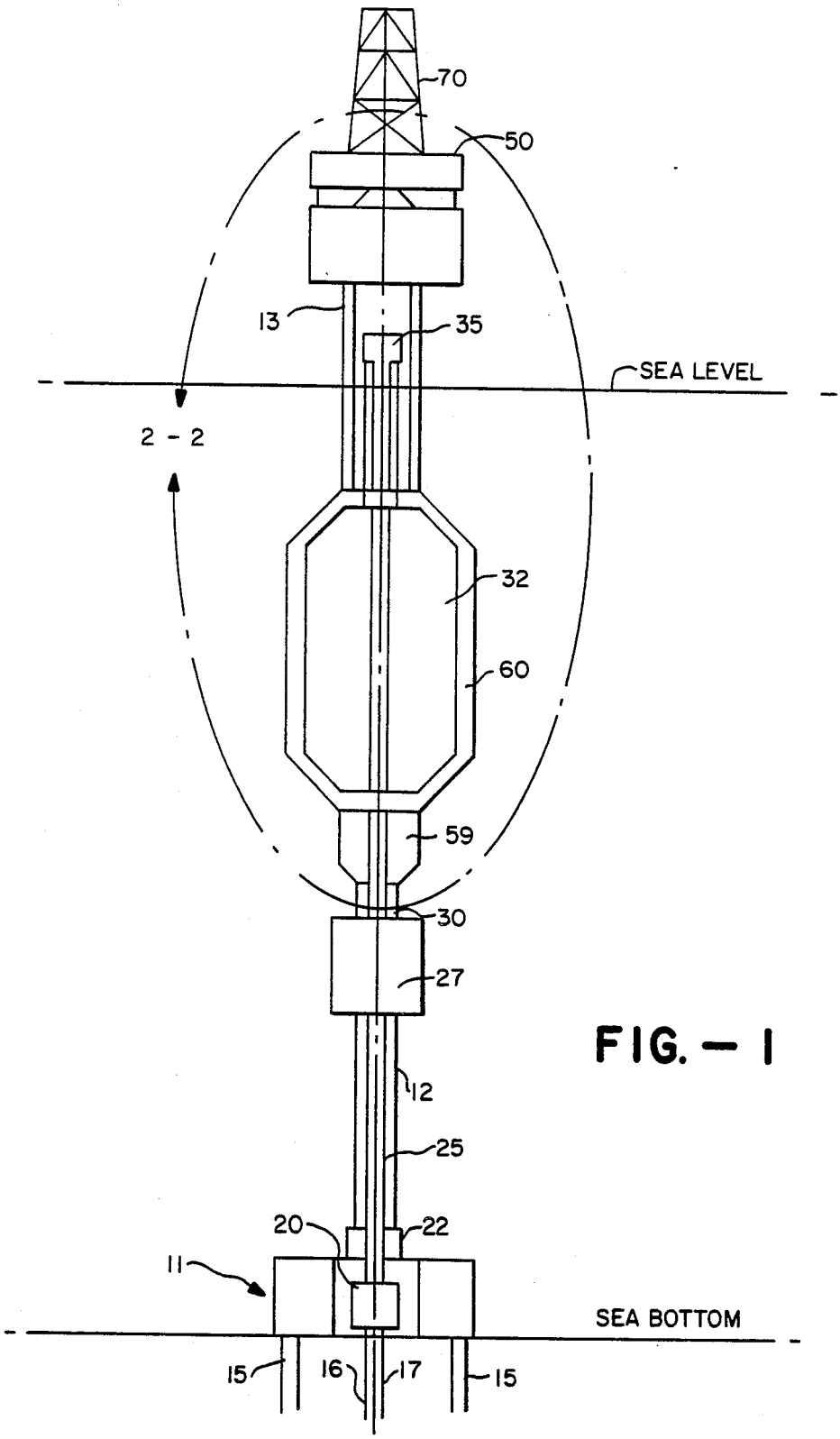
FIG. 1 shows schematically an offshore structure embodying the present invention.
Figure 2:
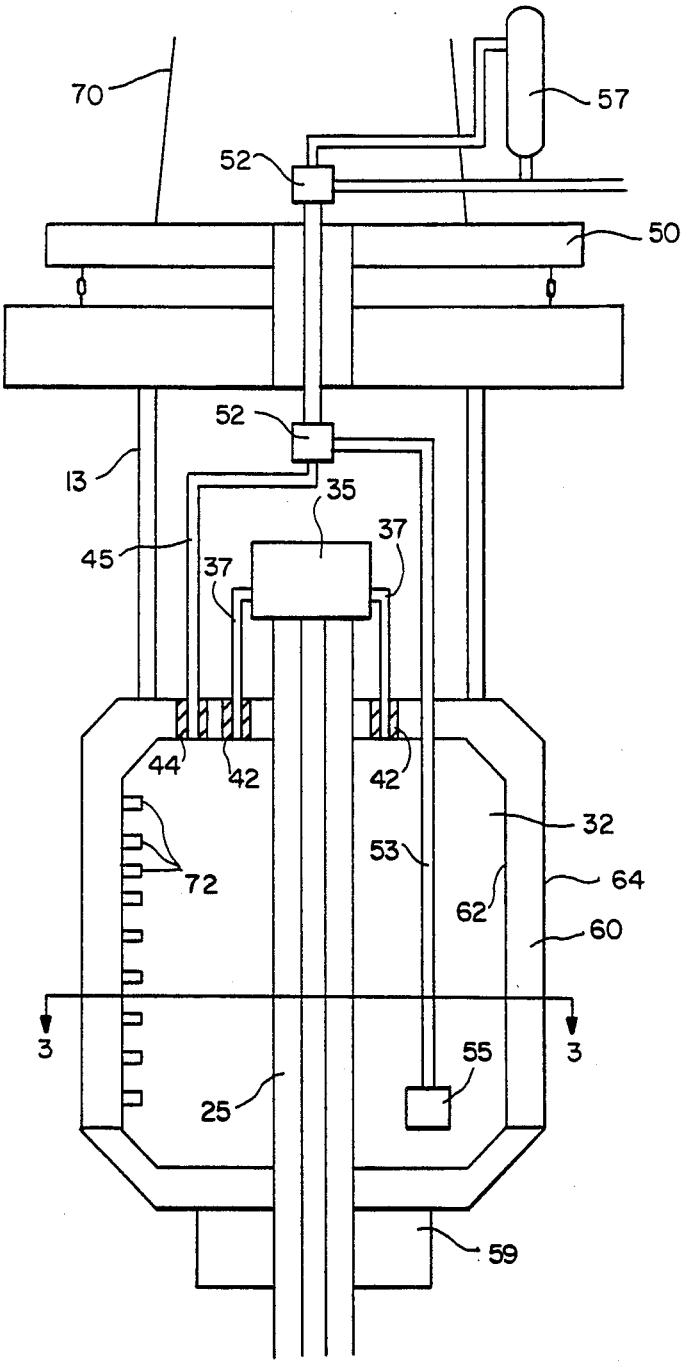
FIG. 2 shows schematically the details of a section of the buoyant body according to the present invention.

There is shown schematically in FIGS. 1 and 2 a deepwater production system of the present invention which, briefly stated, consists of the following three main components: a base assembly 11, a central tension anchor leg assembly 12, or a structure riser, and a buoyant body 13.

The base assembly is a unit engaged with the sea-bed typically by being secured to piles 15 around a well 16. It may be of a conventional design with a central opening sufficiently large cross-sectionally to house therein a wet production tree 20 which is independent of the base assembly 11 as well as maintenance space for divers. The base assembly 11 is preferably sufficiently tall to protect the wet tree 20 from damage by ensuing installation operations. The wet tree 20 is one of the well control means of the system and maybe of a conventional type having minimum process functions. Primarily, it is a safety device at the sea floor which fails safe under loss of hydraulic valve pressure. Well control is further achieved by a subsurface safety valve (or downhole safety valve) 17 in the well 16.

At the top, the base assembly 11 is connected via a universal joint means 22 to the bottom end of the central tension anchor leg assembly 12. The leg assembly 12 is essentially an elongate member connecting the base assembly 11 founded on the sea-bed and the buoyant body 13 which is essentially a semisubmersible tension leg buoy. At the center, there is an independently tensioned production riser assembly 25 for transporting fluids upwards from the well 16 to the buoyant body 13. The leg assembly 12 itself may be buoyant or non-buoyant, depending upon specific site conditions. A riser tensioning bouy 27 may be provided near the top end of the leg assembly 12 in order to facilitate the vertical positioning of the leg assembly 12 when it is installed vertically onto the base assembly 11.

The top end of the leg assembly 12 is connected to the bottom of the buoyant body 13 by another universal joint means 30. The buoyant body 13 has a storage and separation containment means 32 through which the top part of the production riser assembly 25 connects vertically to transport the produced fluids to a dry tree 35 positioned above the containment 32 and above the sea level. The dry tree 35 may be of a conventionally available type where flow control is exercised by an automatic choke with or without a manual override. It is preferably of a type with two wing valves for production, one active and the other used as a stand-by. This will permit switch-over when the active choke must be replaced or maintained. Produced fluids are piped directly from the dry tree 35 through one of its discharge pipes 37 into the containment 32 which serves as a vertical buoy separator. Components from the base of the production tubing to the top of the separator inlet flanges 42 are pressure rated. The pressure inside the containment 32 is controlled by a pressure reducing valve 44 at the outlet flange for a gas outlet pipe 45 through which the gas separated inside the tank 32 is transported upwards to the base of a turntable (rotatable turret) 50 through another swivel joint 52' of Chiksan type. Produced fluids discharged into the tank 32 are transported upwards by a submersible pump 55 through a pipe 53 and the joint 52. Both the produced gas and fluids pass through the same central opening of the turntable 50 and the gas then goes to a scrubber 57 located at the base of a workover rig mast 70 founded on the turntable 50. The workover rig mast 70 also functions as the flare tower. This allows a less expensive floating tender rig to be used for major workover activities such as packer and tubing replacements rather than mobilizing a more expensive rig such as a drill ship. Liquids deposited in the scrubber are discharged back into the containment 32.

The containment 32 is further provided with a fixed ballast 59 at the bottom for keeping the center of gravity of the buoyant body 13 safely low and to minimize tension on the leg assembly 12 even when the containment 32 is empty.

Figure 3:
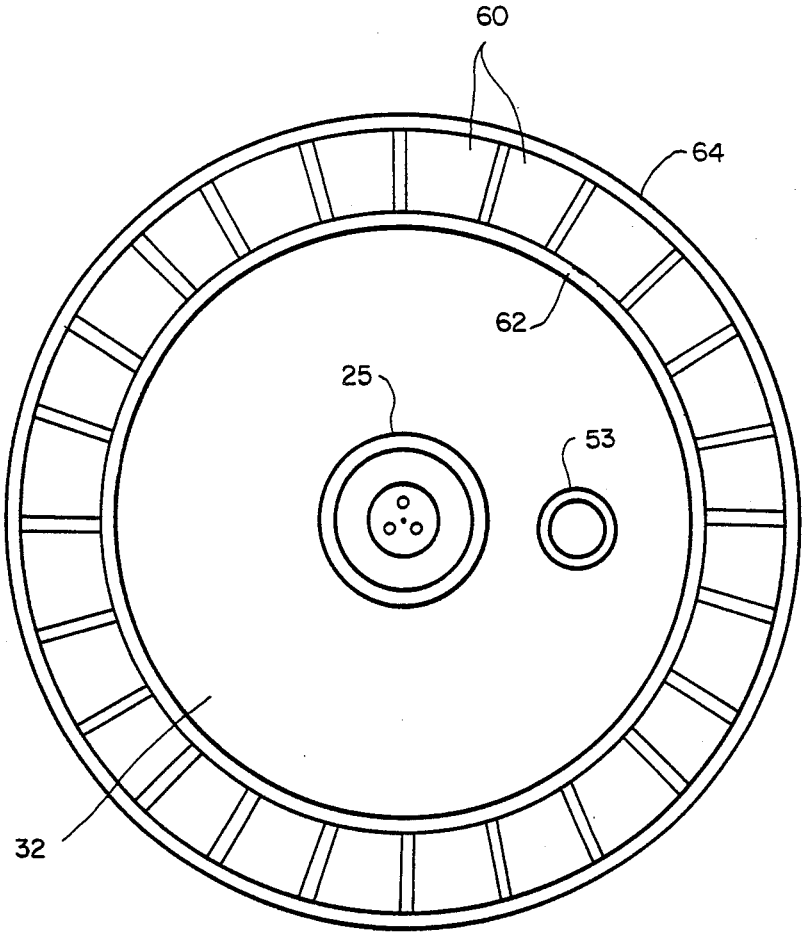
FIG. 3 is a sectional view taken along the line 3—3 of FIG. 2

The containment 32 is of double-wall structure with inner wall 62 and outer wall 64 which may be substantially cylindrical and in coaxial relationship with each other. The interior of the containment 32 is thereby segregated from the sea. The annular space defined between the inner wall 62 and the outer wall 64 is divided into vertically elongated ballast compartments 60 as shown in FIG. 3 wherein the same numerals as defined above by way of FIGS. 1 and 2 are used to indicate the corresponding components. FIG. 3 shows a particular arrangement of compartments 60 but neither the arrangement nor the total number of compartments is intended to limit the scope of this invention.

As conceptually shown in FIG. 2, a plurality of level indicators 72 of a known type are disposed inside the containment 32 and vertically spaced in a known manner. Each level indicator 72 serves to indicate whether the liquid level inside the containment 32 reached its position. According to a preferred embodiment, the level indicators 72 are so positioned that the weight of liquid inside the containment 32 between two levels corresponding to two vertically adjacent level indicators 72 can be balanced by the weight of sea water in one of the ballast compartments 60. In this manner, the buoyant force communicated to the base assembly 11 through the structure riser 12 can be uniformly maintained by ballasting or deballasting an appropriate compartment when a corresponding change in the liquid level inside the containment 32 is detected by the corresponding pair of mutually adjacent level indicators 72 as explained above. In general, liquid level in the containment 32 is constantly monitored by these level indicators 72 and the measured liquid level is telemetered to shore at all times.

In addition, low and high level telemetered alarms may be provided to trigger shutdown.

The buoyant body 13 may further be provided with loaded devices of standard types such as loaded booms, tanker loading hoses, tanker mooring, pipe ramps and/or tender rig mooring bridles. Conventional floating hoses can be used in lieu of the loading boom if site conditions warrent their use. Since this system of the present invention is intended for use in an open seaway, the loading boom method will reduce hose damage and maintenance costs.

Hydraulic power furnished by the tanker will operate the shipping pumps (not shown). The loss of weight during product unloading is compensated by taking on seawater ballast. Operating on the severity of sand production, a desanding device can be placed aboard the shuttle and jet nozzles installed within containment 32.

An offshore structure of present invention provides various advantages. The primary characteristic which differentiates it from the conventional designs is that process and storage facilities are integrally incorporated into a tensioned single central leg anchored system. Since the structure and other components of the present invention are intended for mass production, economic benefits associated with volume fabrication is readily gained. Installation economies are gained by using the exploration rig to place the facility and revenues occur immediately following installation and well completion. If components are manufactured in advance, futhermore, the installation period is extremely short and early cash flow can be achieved.

The system of the present invention can also be used economically because production and ballasting can be monitored by shore-based telemetering which can also be used to control the equipment system. Workover capability is provided with the assistance of a tender rig, thus eliminating the need for a major exploration drilling vessel during the producing phase. Since production is via a single well and through vertically aligned components, direct access is allowed to well bore tubing, casing and other equipment which require periodic maintenance and workover. Conventional downhole tools are sufficient for workovers.

A further advantage of the present invention is found in its use of exploration and delineation wells. Exploration and reservoir delineation wells are often plugged and abandoned while a multiplicity of new wells are drilled from one or more central facilities during the producing phase. By the present invention, the expense of these wells can be recovered and expensive new well drilling can be avoided.

The present invention has been described above in terms of only one embodiment but the description above should be regarded as illustrative rather than as limiting, and should therefore be construed broadly. For example, the accompanying figures are intended to be schematic and not to represent any preferred dimensional relationships or shapes of the various components. Although a design with two joints have been shown, the number of universal joint means in the system is by no means limited to two. Although a hydraulic jack (not shown) may typically be placed below the dry tree 35 for applying tension to the production riser assembly 25, any other type of pressure applying means can be included in the system. The base assembly 11 need not be firmly affixed to a sea floor by being secured to piles; it may be a simple gravity base. The ballastable compartments may be horizontally divided instead of vertically. At a higher investment cost, an offshore structure of the present invention can even be made adaptable for a multiwell subsea system. The scope of the present invention is therefore to be considered limited only by the following claims.

I claim:

1. An offshore structure for deepsea production comprising a base founded on a sea-bed, a buoyant body of double-wall structure having an outer wall and a containment means which is integrally a part of said buoyant body and is enveloped by said outer wall such that the pressure therein is maintained independently of the pressure outside said buoyant body, said containment means and said outer wall defining therebetween a controllably ballastable and deballastable space, a leg connected to said base and to said buoyant body so as to substantially prevent vertical motions of said buoyant body, and a production riser connecting said containment means with a subsea production tree which is independent of said base.

2. The structure of claim 1 wherein said base contains a wet production tree.

3. The structure of claim 1 wherein said buoyant body contains a dry tree.

4. The structure of claim 1 wherein said leg is connected to said base and to said buoyant body respectively by a universal joint means.

5. The structure of claim 1 futher comprising a means for controllably ballasting and deballasting said containment area.

6. The structure of claim 1 wherein said buoyant body includes a rotatable turret.

7. The structure of claim 1 wherein said containment means is vertically elongate.

8. The structure of claim 1 wherein said containment means is adapted to control the level of tension to said base through said leg by adjusting buoyancy thereof through ballasting or deballasting.

9. The structure of claim 1 wherein said base is founded over a well and said leg is aligned to said well.

10. The structure of claim 5 wherein said ballasting and deballasting means is adapted to control the tension to said base and said leg to approximately uniform levels.

11. The structure of claim 1 further comprising level indicators for controlling the tension to said base and said leg to approximately uniform levels by balancing the weight of ingress and egress of liquids in said containment means by deballasting and ballasting said space, respectively.

12. An offshore structure for deepsea production comprising a base founded on a sea-bed, a buoyant body supporting a production riser assembly, said buoyant body including a container connected through said production riser assembly to a subsea production tree which is independent of said base, said container being integrally a part of said buoyant body, and a leg connected to said base and to said buoyant body so as to substantially prevent vertical motions of said buoyant body.

13. The structure of claim 12 wherein said buoyant body includes controllably ballastable and deballastable chambers with an enclosure maintaining its interior in a pressure-noncommunicating relationship with the exterior surroundings of said buoyant body.

14. The structure of claim 12 wherein said leg is connected to said base and to said buoyant body respectively by a universal joint means.

15. The structure of claim 13 further comprising level indicators for controllably ballasting and deballasting said containment means to control the tension to said base and said leg to approximately uniform levels.

16. The structure of claim 13 wherein said production riser assembly connects to said containment means.

17. The structure of claim 1 wherein said leg is tubular and encloses said production riser.

18. The structure of claim 1 wherein said space between said containment means and said outer wall is divided into compartments.

* * * * *